US005313014A

United States Patent [19]

Kosugi et al.

[11] Patent Number: 5,313,014

[45] Date of Patent: May 17, 1994

[54] ELECTRONIC MUSICAL INSTRUMENT HAVING SOUND IMAGE LOCALIZATION CIRCUIT

[75] Inventors: Taichi Kosugi; Takashi Suzuki, both of Shizuoka, Japan

[73] Assignee: Kabushiki Kaisha Kawai Gakki Seisakusho, Japan

[21] Appl. No.: 60,247

[22] Filed: May 11, 1993

[30] Foreign Application Priority Data

Jun. 24, 1992 [JP] Japan ..... 4-188959

[51] Int. Cl.[5] ..... G10H 1/02; G10H 7/00

[52] U.S. Cl. ..... 84/632; 84/DIG. 1; 84/DIG. 27; 84/633

[58] Field of Search ..... 84/622, 633, 630, DIG. 1, 84/DIG. 26, DIG. 27, 659, 665

[56] References Cited

U.S. PATENT DOCUMENTS

| | | | |
|---|---|---|---|
| 4,622,878 | 11/1986 | Sharp | 84/DIG. 1 |
| 4,998,960 | 3/1991 | Rose et al. | 84/DIG. 1 |
| 5,027,689 | 7/1991 | Fujimori | 84/DIG. 27 |
| 5,153,362 | 10/1992 | Toda et al. | 84/DIG. 27 |
| 5,198,604 | 3/1993 | Higashi et al. | 84/DIG. 27 |

FOREIGN PATENT DOCUMENTS 6149397 9/1984 Japan .

*Primary Examiner*—William M. Shoop, Jr.
*Assistant Examiner*—Helen Kim
*Attorney, Agent, or Firm*—Andrus, Sceales, Starke & Sawall

[57] ABSTRACT

An electronic musical instrument incorporates at least two tone signal outputs and controls sound image localization of musical tones in accordance with localization data by changing the levels of at least first and second tone signals provided, respectively, to the tone signal outputs. The instrument includes a tone signal generator for generating a generated tone signal and an output control data production circuit receiving the localization data and providing tone signal volume data and a selection signal. A tone signal output level control receives the generated tone signal and provides the first and second tone signals to the tone signal output. The tone signal output level control has a multiplier for altering the generated tone signal responsive to said volume data to provide one of the first and second tone signals. The tone signal output level control provides a signal corresponding to the generated tone signal unaltered by any multiplication as the other of the first and second tone signals. The tone signal output level control has a pair of selectors responsive to the selection signal for providing one of the first and second tone signals to one of the tone signal outputs and for providing the other of the first and second tone signals to the other of the tone signal outputs, thereby to control sound image localization of the musical sounds of the electronic musical instrument.

7 Claims, 8 Drawing Sheets

FIG. 4A
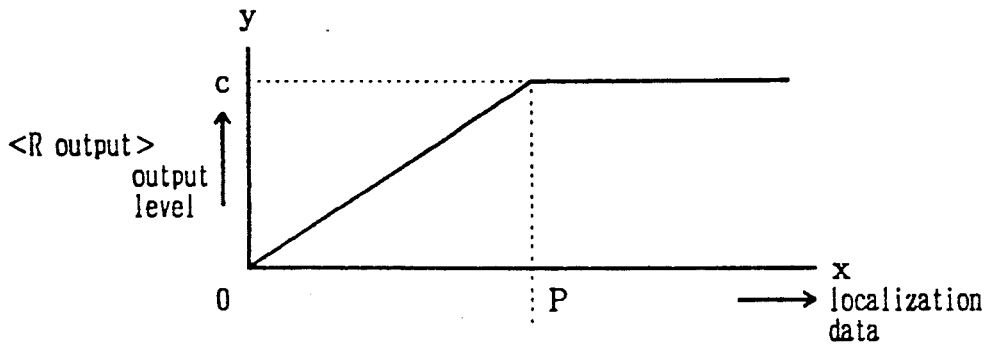
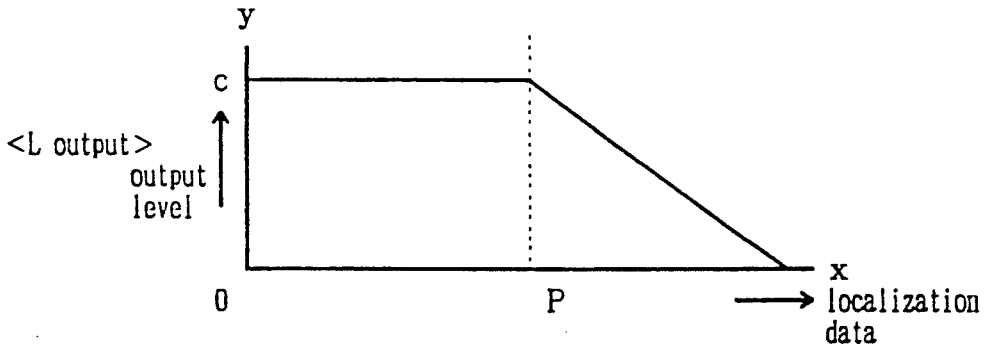
FIG. 4B

ELECTRONIC MUSICAL INSTRUMENT HAVING SOUND IMAGE LOCALIZATION CIRCUIT

BACKGROUND OF THE INVENTION

Field of the Invention

The present invention relates to an electronic musical instrument that is designed to control image sound localization of output musical tones.

Description of the Related Art

Usually, electronic musical instruments that have two output systems for tone signals perform sound image localization by employing, for this purpose, two tone signal output levels, e.g., a right output volume level and a left output volume level (hereafter referred to as "R output" and "L output", respectively).

As illustrated in FIG. 1, a localization data/volume data conversion section 2 of a conventional electronic musical instrument produces at least two sets of volume data, e.g., volume data a and b, when it receives sound image localization data for a tone signal that is generated by a tone signal generation means 1.

The volume data a and b are transmitted respectively to at least two multipliers, 3Ma and 3Mb, that are included in a tone signal output level control means 3. The tone signal that is produced by the tone signal generation means 1 is also transmitted to the multipliers 3Ma and 3Mb. The multipliers 3Ma and 3Mb, respectively, multiply the tone signal, which is generated by the tone signal generation means 1, by the received volume data a and b to obtain output levels for that tone signal.

In a tone signal output means 4 at least two digital-/analog converters (hereafter referred to as "D/A converters") are paired with a like number of amplifiers, in this instance. D/A converter/amplifier pairs 4Ca/4Aa and 4Cb/4Ab, which correspond respectively to the multipliers 3Ma and 3Mb. These D/A converter/amplifier pairs produce, for example, R outputs and L outputs. Tone signals with these output levels are transmitted by the tone signal output means 4 to loudspeakers, which produce, in turn, musical tones from the given signals.

The output level status of tone signals, i.e., the difference in the amplitudes of the R output and the L output, is employed to perform sound image localization of output musical tones.

An example of an electronic musical instrument that controls sound image localization of musical tones by employing variable R output and L output volumes is described in Japanese Unexamined Utility Model Application No. Sho 61-49397.

When the conventional electronic musical instrument depicted in FIG. 1 performs sound image localization of musical tones, localization data are employed to produce at least two sets of volume data. The volume data sets are then multiplied individually by a single tone signal and two tone signals are thereby obtained.

The conventional electronic musical instrument, therefore, either must have at least two multipliers, or must perform the multiplication process at least twice.

Since multipliers generally require large circuits, they are expensive, and the number of them that is used directly affects the unit manufacturing cost. That is, as the number of multipliers provided increases, so too does the unit manufacturing cost.

When, to reduce the unit manufacturing cost, only one multiplier is provided and time-sharing, for example, is employed for iterative multiplication, unit operational speed drops and the time required to determine two output levels for sound image localization increases.

As a multiplier circuit that will yield a higher operational speed tends to be complicated, designing an electronic musical instrument that incorporates such a circuit is difficult.

SUMMARY OF THE INVENTION

To overcome the above described shortcomings, it is an object of the present invention to provide an electronic musical instrument that incorporates a simpler circuit to perform sound image localization rapidly and that can be produced at a lower cost.

To achieve the above object, an electronic musical instrument according to the present invention, which incorporates at least two tone signal output means, and which controls sound image localization of musical sounds by changing the levels of at least two tone signals that are received by the tone signal output means, comprises:

tone signal generation means for generating a tone signal;

output control data production means for employing localization data to prepare output control data for the tone signal;

tone signal output level control means for selecting, upon receipt of output control data from the output control data production means, an output level for the tone signal and transmitting the output level to one of tone signal output means, and for selecting, without using output control data from the output control data production means, an output level for the tone signal and transmitting the output level to the other tone signal output means.

When an electronic musical instrument of the present invention changes the levels of at least two tone signals for sound image localization of a musical tone, it employs output control data that is sent from the output control data production means in the selection of the level for one of the tone signals, but does not employ such data in the selection of the level for the other tone signal.

BRIEF DESCRIPTION OF THE DRAWINGS

FIG. 4*a* and *b* are explanatory diagrams of the output characteristics that are obtained by the sound image localization means of the electronic musical instrument according to the present invention;

DETAILED DESCRIPTION OF THE PREFERRED EMBODIMENTS

The preferred embodiments of an electronic musical instrument according to the present invention will now be described while referring to the accompanying drawings.

Figure 2:
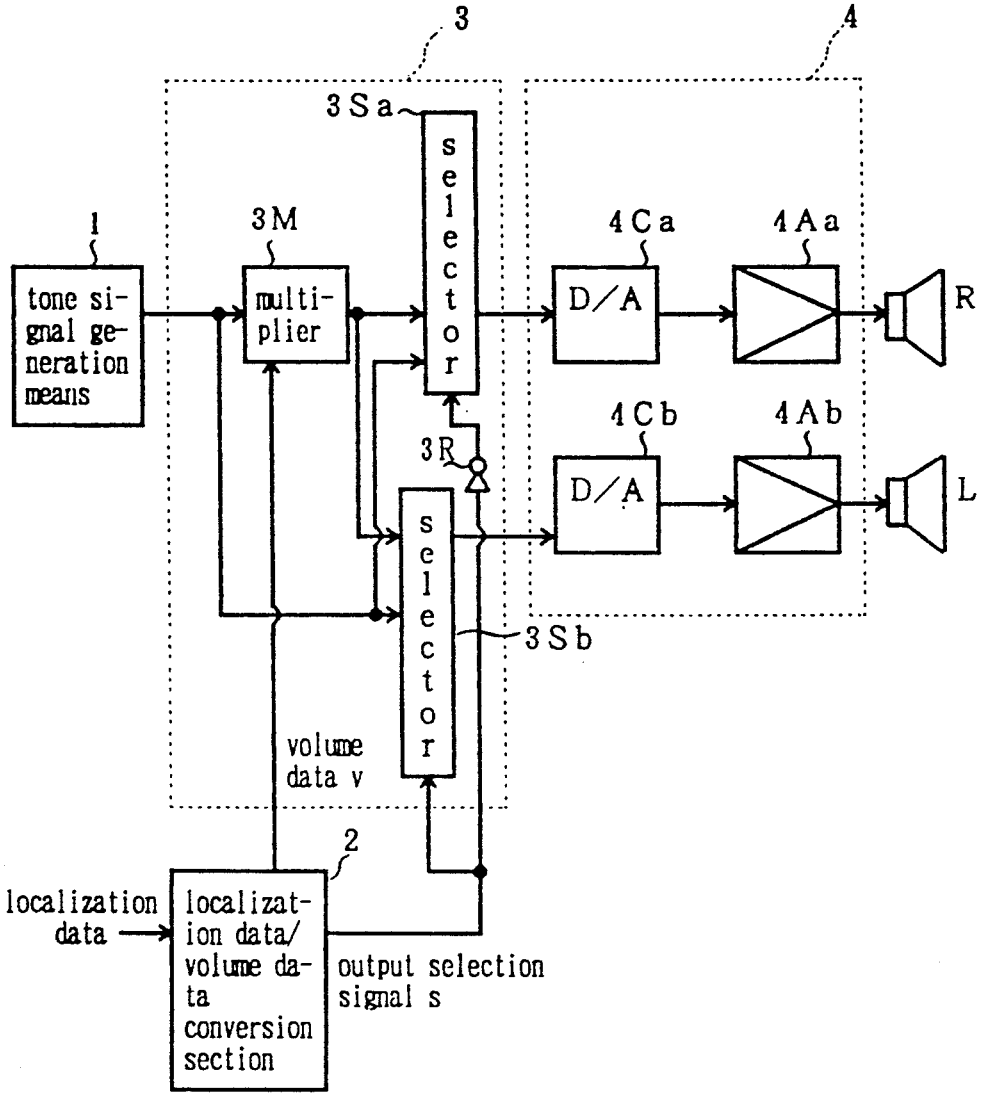
FIG. 2 is a schematic block diagram showing the arrangement of the essential elements of a sound image localization means of an electronic musical instrument according to the present invention.

FIG. 2 is a schematic block diagram showing the arrangement of the essential elements of a sound image localization means that is employed in an electronic musical instrument according to the present invention.

Figure 1:
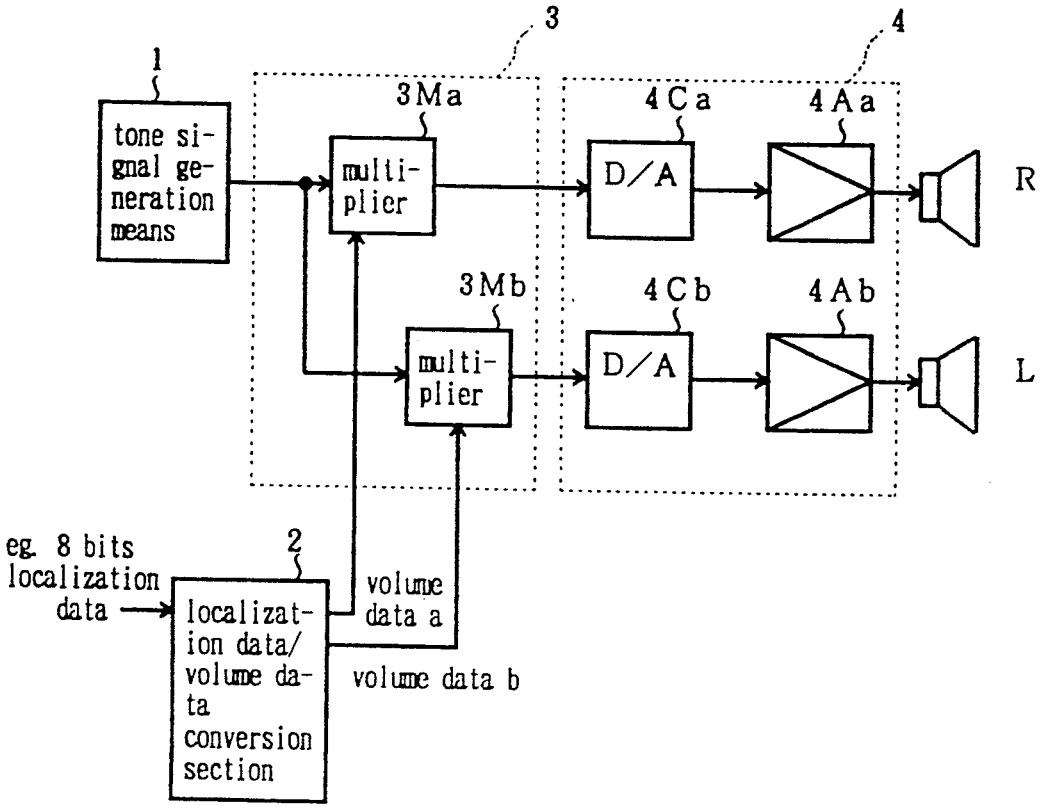
FIG. 1 PRIOR ART
FIG. 1 is a block diagram illustrating the essential elements of a sound image localization means of a conventional electronic musical instrument.

As is evident from FIG. 2, the arrangement of the sound image localization means of the present invention is substantially the same as the one that is depicted in FIG. 1.

More specifically, the sound image localization means includes the tone signal generation means 1; the tone signal output level control means 3, which is connected to the tone signal generation means 1; the localization data/volume data conversion section 2 as an output control data production means, which is connected to the tone signal output level control means 3 and which, upon receipt of sound image localization data, prepares volume data v and an output selection signal s and transmits them to the tone signal output level control means 3; and the tone signal output means 4, which is connected to the tone signal output level control means 3 and which receives at least two levels of tone signals that are selected by the tone signal output level control means 3.

The tone signal output level control means 3 includes a multiplier 3M, which is connected to the tone signal generation means 1 and which receives a tone signal from the tone signal generation means 1; selectors 3Sa and 3Sb, which are connected to the multiplier 3M and to the tone signal generation means 1 and which receive the output signal from the tone signal generation means 1 both directly and indirectly, i.e., through the multiplier 3M; and a signal inversion means 3R, which is located between the selector 3Sa and the localization data/volume data conversion section 2 and which is connected thereto to invert an output selection signal s that is transmitted from the localization data/volume data conversion means 2 to the selector 3Sa.

In the thus structured sound image localization means of the present invention, a tone signal generated by the tone signal generation means 1 is transmitted to the selectors 3Sa and 3Sb via the multiplier 3M of the tone signal output level control means 3, i.e., after multiplication is performed on the tone signal by the multiplier 3M. Concurrently, that tone signal is transmitted to the selectors 3Sa and 3Sb directly without passing through the multiplier 3M.

The localization data/volume data conversion means 2 produces volume data v and an output selection signal s, in consonance with data about sound image localization of a musical tone, i.e., localization data.

Volume data v are represented by values of "0" to "1".

The output selection signal s is transmitted to the selectors 3Sa and 3Sb. These selectors decide whether to transmit to the tone signal output means 4 the tone signal they receive that has been processed by the multiplier 3M, of the tone signal output level control means 3, or the one they receive directly from the tone signal generation means 1, which does not transit the multiplier 3M.

Figure 3:
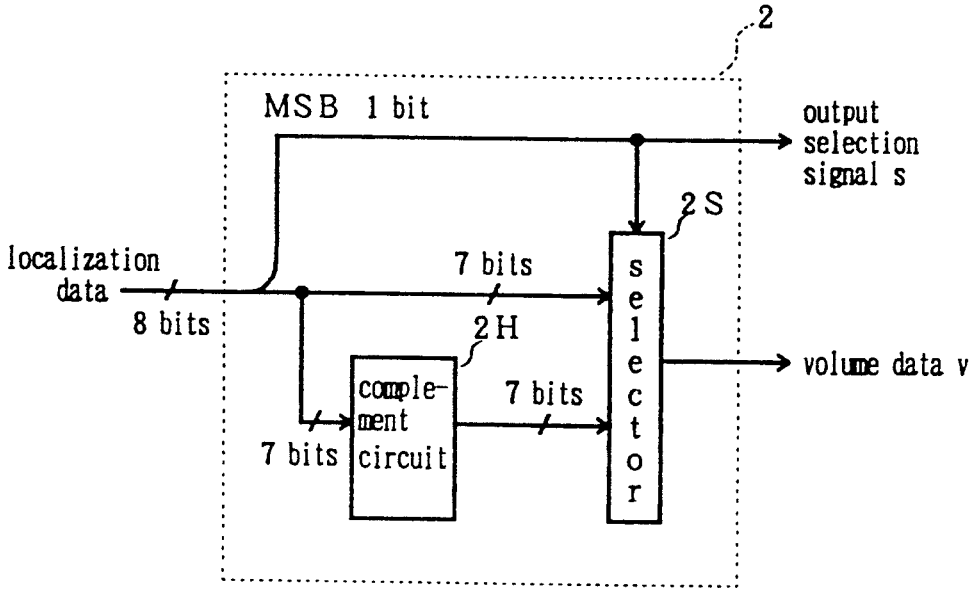
FIG. 3 is a block diagram for explaining an exemplary of a localization data/volume data conversion section for the electronic musical instrument according to the present invention.

An example, detailed arrangement for the localization data/volume data conversion section 2 is shown in FIG. 3. In this example, localization data is represented by 8-bit data values.

The most significant bit, MSB, of the eight bits is used as an output selection signal s. The remaining seven bits are used as volume data v.

As shown in FIG. 3, the localization data/volume data conversion section 2 includes a complement circuit 2H and a selector 2S.

The complement circuit 2H receives the lower seven bits, i.e., the volume data v. The selector 2S receives the lower seven bits as well, and also receives, from the complement circuit 2H, signals for the lower seven bits, i.e., the complements of the lower seven bits.

In addition, the selector 2S receives the MSB as an output selection signal s.

According to the thus arranged localization data/volume data conversion means 2, when the MSB of the received 8-bit data holds a value of "0", the selector 2S chooses the lower seven bits and outputs them as volume data v. When the MSB has a value of "1", the selector 2S chooses the complements of the lower seven bits and outputs them as volume data v.

The processing of the tone signal output level control means of the present invention shown in FIG. 2 will now be explained.

When the MSB of the 8-bit localization data has a value of "0", an output selection signal s is set to "0" and the selector 2S, of the localization data/volume data conversion means 2, chooses and outputs the lower seven bits as volume data v.

The selector 3Sa receives an output selection signal s that is inverted by the signal inversion means 3R, i.e., an output selection signal s that has a value of "1", and selects and outputs to the D/A converter 4Ca, of the tone signal output means 4, a tone signal that is transmitted from the tone signal generation means 1 directly, that is, without passing through the multiplier 3M.

Upon receipt of an output selection signal s that has a value of "0", the selector 3Sb of the tone signal output level control means 3 selects and outputs to the D/A converter 4Cb, of the tone signal output means 4, a tone signal that has been generated by the tone signal generation means 1 and that the multiplier 3M has multiplied by the volume data v.

The final output levels of the tone signals are respectively determined by the amplifiers 4Aa and 4Ab, of the tone signal output means 4, and are employed, as the R output volume and the L output volume, to control sound image localization.

When the MSB of the 8-bit localization data has a value of "1", an output selection signal s is set to "1" and the selector 2S, of the localization data/volume data conversion means 2, chooses the complements of the lower seven bits and outputs them as volume data v.

The selector 3Sa receives an output selection signal s that is inverted by the signal inversion means 3R, i.e., an output selection signal s that has a value of "0", and selects and outputs to the D/A converter 4Ca, of the tone signal output means 4, a tone signal that is transmitted from the tone signal generation means 1 through the multiplier 3M, i.e., a tone signal that the multiplier 3M has multiplied by the volume data v.

Upon receipt of an output selection signal s that has a value of "1", the selector 3Sb, of the tone signal output level control means 3, chooses and directly outputs to the D/A converter 4Cb, of the tone signal output means 4, a tone signal that is generated by the tone signal generation means 1.

The final output levels of the tone signals are respectively determined by the amplifiers 4Aa and 4Ab, of the tone signal output means 4, and are employed, as the R output volume and the L output volume, to control sound image localization.

FIGS. 4*a* and 4*b* illustrate the R output and L output changes that are effected by controlling sound image localization, and the relationship between the two outputs.

As shown in FIGS. 4*a* and 4*b* as the localization data value increases along the x axis, the level of the R output increases gradually and linearly. When the localization data value reaches point P along the x axis, the output level stabilizes at level C.

The level of the L output remains at level C until the localization data value increases and reaches point P along the x axis. When the localization data value increases further, the output level decreases gradually and linearly.

In this relationship between the R output and the L output, when the value of the localization data is "0", i.e., at the origin, and the L output is greater than the R output, it is assumed that tone signals emanate from the left, i.e., the L side.

During the period wherein the localization data value advances from the origin and the R output level gradually rises, it is assumed that emanation of the tone signals progresses from the left to the right, i.e., moves to the R side.

When the value of the localization data reaches point P along the x axis and the L output is equal to the R output, it is assumed that the tone signals emanate from the center.

During the period wherein the localization data value further increases from point P and the L output gradually decreases, it is assumed that emanation of the tone signals progresses from the center to the right, i.e., moves to the R side.

Since the above described electronic musical instrument according to this embodiment of the present invention has only a single multiplier 3M, which employs localization data to control the R output and L output levels, the structure of the multiplier circuit can be simplified without adversely affecting the operating speed, i.e., the response speed.

In this embodiment, the R output and L output levels are changed proportionally, i.e., linearly, as shown in FIG. 4. The R output and L output changes, however, can be adjusted so that they describe an arc, as shown in FIG. 5, and so that a natural acoustic progression is provided as the focal point of the sound image changes.

Figure 5:
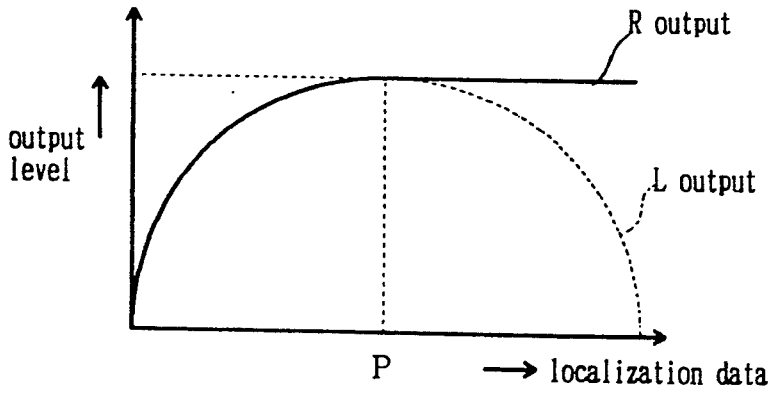
FIG. 5 is an explanatory diagram of another output characteristics that are obtained by the sound image localization means of the electronic musical instrument according to the present invention.
Figure 6:
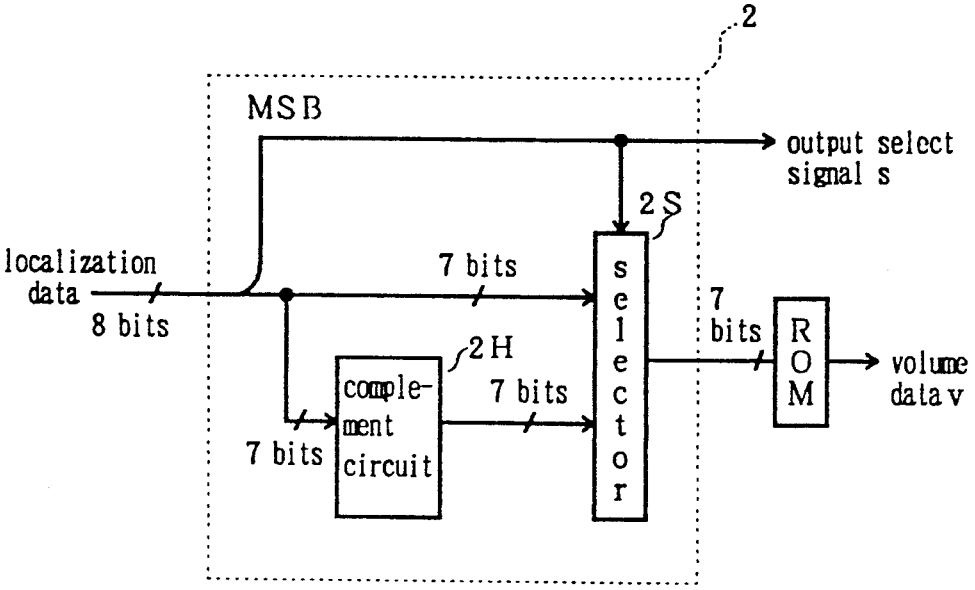
FIG. 6 is a block diagram for explaining another exemplary of a localization data/volume data conversion section for the electronic musical instrument according to the present invention.
Figure 7:
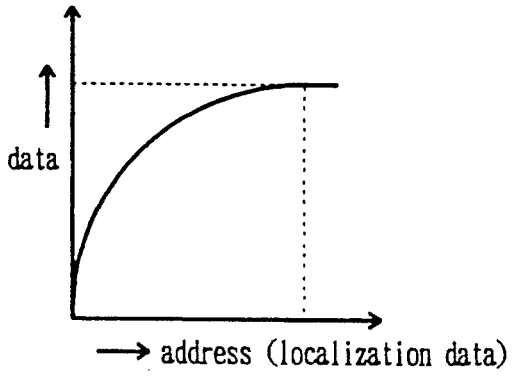
FIG. 7 is a graph for explaining the characteristic table of a ROM that is included in the exemplary arrangement, shown in FIG. 6, for the localization data/volume data conversion section of the electronic musical instrument according to the present invention.

To change the R output and L output levels to describe the arc as illustrated in FIG. 5, as shown in the example in FIG. 6, a read only memory (hereafter referred to as "ROM") illustrated in FIG. 7 that holds a characteristic table may be connected to the selector 2S of the localization data/volume data conversion means illustrated in FIG. 3. Volume data v, the lower seven bits of the 8-bit localization data, that is transmitted by the selector 2S is compensated in the ROM and acquires the output characteristics that are shown in FIG. 5.

Figure 8:
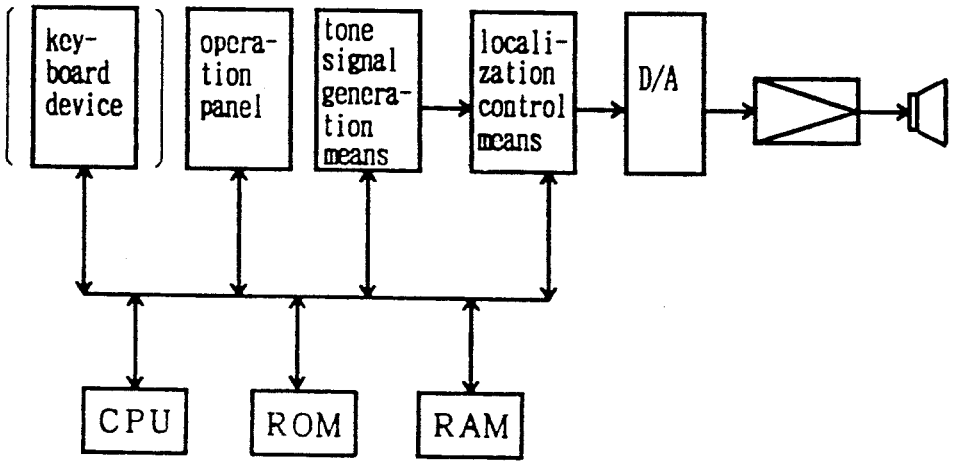
FIG. 8 is a block diagram for explaining the general arrangement of a modification of the electronic musical instrument according to the present invention.

An arrangement shown in FIG. 8 is for another embodiment of an electronic musical instrument according to the present invention.

Select switches, such as timbre and musical instrument select switches, are provided on an operation panel. When these switches are manipulated, a central processing unit (CPU) reads data that is previously stored in a random access memory (RAM). The CPU then controls an electronic musical instrument in consonance with the read-out data, as described in the previous embodiment.

To perform sound image localization of musical tones, an electronic musical instrument of the present invention, unlike a conventional electronic musical instrument, does not have to produce, and process individually, a minimum of two volume data values from localization data. As the circuit structure is therefore simpler and easier to design, an electronic musical instrument according to the present invention, which can perform sound image localization of musical tones without reducing the operating speed, can be manufactured at a lower cost.

What is claimed is:

1. An electronic musical instrument, which incorporates at least two tone signal output means, and which controls sound image localization of the musical sounds of the instrument in accordance with localization data by changing the levels of at least first and second tone signals that are provided, respectively, to said tone signal output means, said instrument comprising:

tone signal generation means for generating a tone signal;

output control data production means receiving the localization data and providing tone signal volume data and a selection signal; and tone signal output level control means receiving said generated tone signal and providing said first and second tone signals to said tone signal output means, said tone signal output level control means having means for altering the generated tone signal responsive to said volume data to provide one of said first and second tone signals, said tone signal output level control means providing a signal corresponding of the tone signal generated by said tone signal generation means as the other of said first and second tone signals, said tone signal output level control means having selection means responsive to said selection signal for providing one of said first and second tone signals to one of the tone signal output means, and for providing the other of said first and second tone signals to the other of the tone signal output means, thereby to control sound image localization of the musical sounds of the electronic musical instrument.

2. An electronic musical instrument according to claim 1 wherein said tone signal output level control means includes a multiplier responsive to said volume data for altering said generated tone signal.

3. An electronic musical instrument according to claim 1 further defined as one for altering the musical characteristics of the musical sounds of the instrument and further comprising:

a memory containing data for the musical characteristics;

a data processor for processing the data and for providing said data to the electronic musical instrument for altering the musical characteristics; and control means or controlling the operation of said data processor.

4. An electronic musical instrument according to claim 1 wherein the localization data is represented by eight-bit data values and wherein said output control data production means employs the most significant bit as the selection signal and the remaining seven bits as the volume data.

5. An electronic musical instrument according to claim 4 wherein the bits of localization data have pairs of binary states and wherein said output control data production means provides volume data in which the its have a given binary state configuration for one binary state of the most significant bit and provides volume data which is the complement of the given binary state configuration for the other binary state of the most significant bit.

6. An electronic musical instrument according to claim 1 wherein said altering means is further defined as carrying out a linear alteration of the magnitude of the generated tone signal responsive to the volume signal.

7. An electronic musical instrument according to claim 1 wherein said catering means is further defined as carrying out a non-linear alteration of the generated tone signal responsive to the volume signal.

* * * * *

UNITED STATES PATENT AND TRADEMARK OFFICE

CERTIFICATE OF CORRECTION

PATENT NO. : 5,313,014

DATED : May 17, 1994

INVENTOR(S) : Kosugi et al

It is certified that error appears in the above-indentified patent and that said Letters Patent is hereby corrected as shown below:

CLAIM 1, Col. 6, Line 52, delete "of" and substitute therefor ---to---; CLAIM 3, Col. 7, Line 8, delete "or" and substitute therefor ---for---; CLAIM 5, Col. 8, Line 2, delete "its" and substitute therefor ---bits---; CLAIM 7, Col. 8, Line 14, delete "catering" and substitute therefor ---altering---

Signed and Sealed this

Seventh Day of March, 1995

*Attest:*

Bruce Lehman

BRUCE LEHMAN

*Attesting Officer*

*Commissioner of Patents and Trademarks*